United States Patent [19]

Hawkes

[11] Patent Number: 5,054,755

[45] Date of Patent: Oct. 8, 1991

[54] JOIST HANGER MOUNTING TOOL

[76] Inventor: Lester K. Hawkes, H.C.R. 72, Box 3176, E. Waterboro, Me. 04030

[21] Appl. No.: 568,180

[22] Filed: Aug. 16, 1990

[51] Int. Cl.[5] ..... B25B 5/14

[52] U.S. Cl. ..... 269/3; 269/904; 269/41; 269/259 R; 269/239

[58] Field of Search ..... 29/281.1, 281.5, 281.6, 29/271; 269/904, 41, 3, 6, 237–239, 254 R, 155

[56] References Cited

U.S. PATENT DOCUMENTS

| | | | |
|---|---|---|---|
| 1,192,267 | 7/1916 | Bond | 269/239 |
| 2,911,022 | 11/1959 | Brown | 269/41 |
| 3,017,174 | 1/1962 | Reuter | 269/904 |
| 3,357,464 | 12/1967 | Vroman | 269/239 |
| 4,165,869 | 8/1979 | Williams | 269/904 |
| 4,479,639 | 10/1984 | Kane | 269/254 R |
| 4,485,543 | 12/1984 | Flares et al. | 269/904 |

*Primary Examiner*—Robert C. Watson

[57] ABSTRACT

A hand tool for mounting U-shaped joist hangers upon header beams to support the series of joists to be distributed therealong. The joist hanger itself is slid into the forward face of the tool body with its bottom transverse portion entering a rearwardly-extending slot from its front face and over a forwardly-extending projection adapted to align the tool and hanger with the bottom edge of the beam. Angle-section legs of the hanger extend upwardly from the transverse portion and lie flush against the sides of the tool. A spring-biased projection extends from the top of the tool above the bottom projection and hanger to clamp them to the header beam and permit the worker to use his hand for nailing the hanger to the header beam.

4 Claims, 4 Drawing Sheets

Figure 3:
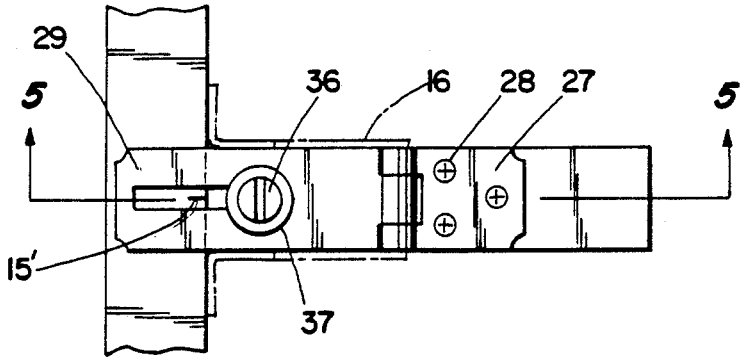

Fig. 1
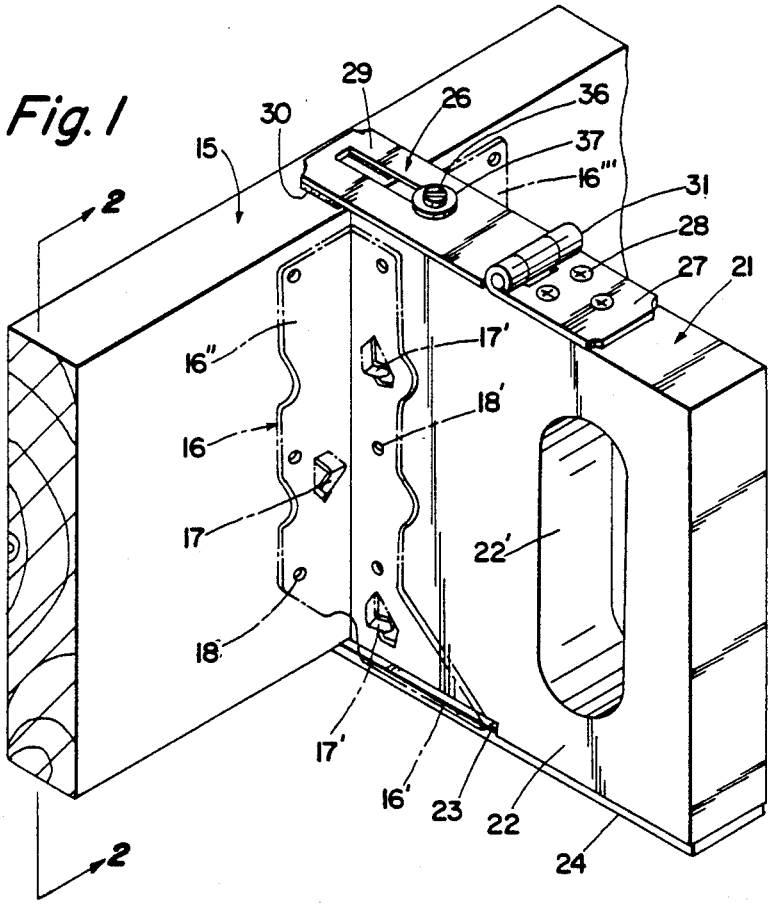
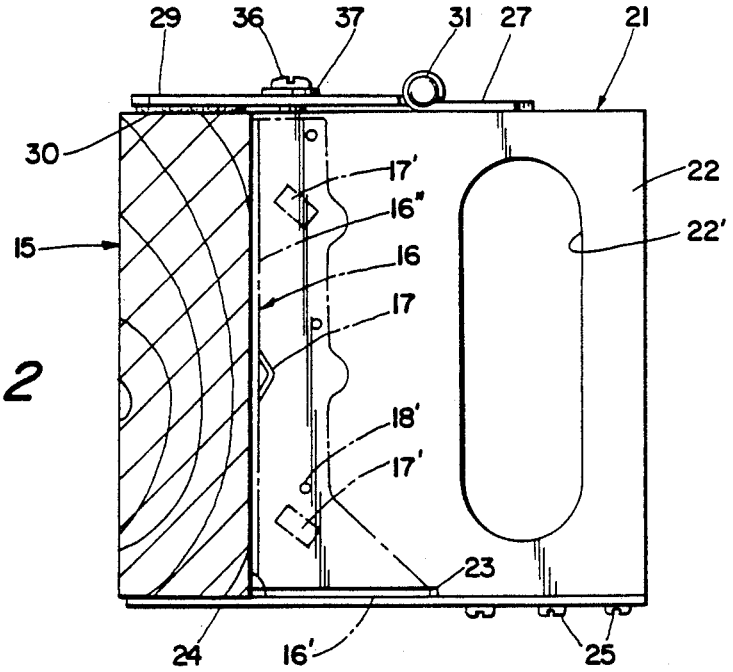
Fig. 2

JOIST HANGER MOUNTING TOOL

This invention relates to a tool for mounting joist hangers upon header beams.

In U.S. Pat. No. 3,601,428, there is shown a joist hanger of the type for which the present tool is adapted for use in placing and securing joist hangers upon beam centers to support them. These hangers are provided with integral prongs for their initial securement to the beam and the joists are supported from the secured hangers. For final attachment, nails are used in addition to the prongs to give added holding power.

It has been difficult to mount these hangers without a tool to hold them upon the beam at the exact centers for the initial hammering of the prongs upon the side face of the beam and each one vertically-aligned thereon. They must all be placed at the same exact height upon the beam. To so register the hangers each time is near impossible. With the several joists in place in the hangers their upper edges along with beams must all lie in the same plane to have the final nailed flooring level and even. The hanger must be steadied with one hand while using a hammer with the other hand. The hanger, cannot lie twisted upon the beam. They must be absolutely vertical for the joist to properly rest in the hangers.

It is, therefore, the principal object of the present invention to provide a tool for use in mounting joist hangers upon header beams, so that the hanger is placed upon the side face of the header in location for immediate hammering of integral prongs into the wood face.

It is another object of the invention to provide a joist hanger mounting tool that can be affixed to the header beam with the joist hanger to free the workers hands for effecting the nailing of the hanger to the header beam and even without need of integral prongs with the hanger.

It is still another object of the invention to provide a joist hanger mounting tool that has a top spring-biased plate to effect clamping of the mounting tool upon the header beam to hold the tool and hanger against displacement from the header beam when mounting the joist hanger thereon.

It is a further object of the invention to provide a joist hanger mounting tool for placing joist hangers upon header beams which is adapted for use with plain U-shaped hanger, without the integral nails, as well as for the integral nail hanger, the hanger being clamped to the beam by the mounting tool to free to worker's hands to do the job with regular nails.

Further objects of the invention are to provide a joist hanger mounting tool, having the above objects in mind, which is of simple construction, has a minimum number of parts, hand held, durable, light in weight, inexpensive to manufacture, effective and efficient to use.

For a better understanding of invention, reference should be made to the following detailed description taken with the accompanying drawing, in which, FIG. 1 is a perspective view of the joist hanger mounting tool with an integral nail joist hanger attached a header beam preparatory to the hammering of the integral prongs and regular nails for securement thereto.

Figure 4:
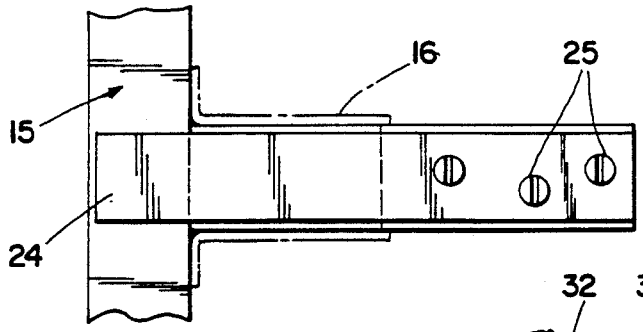
Figure 6:
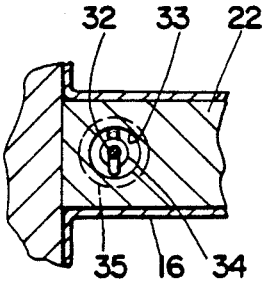
Figure 5:
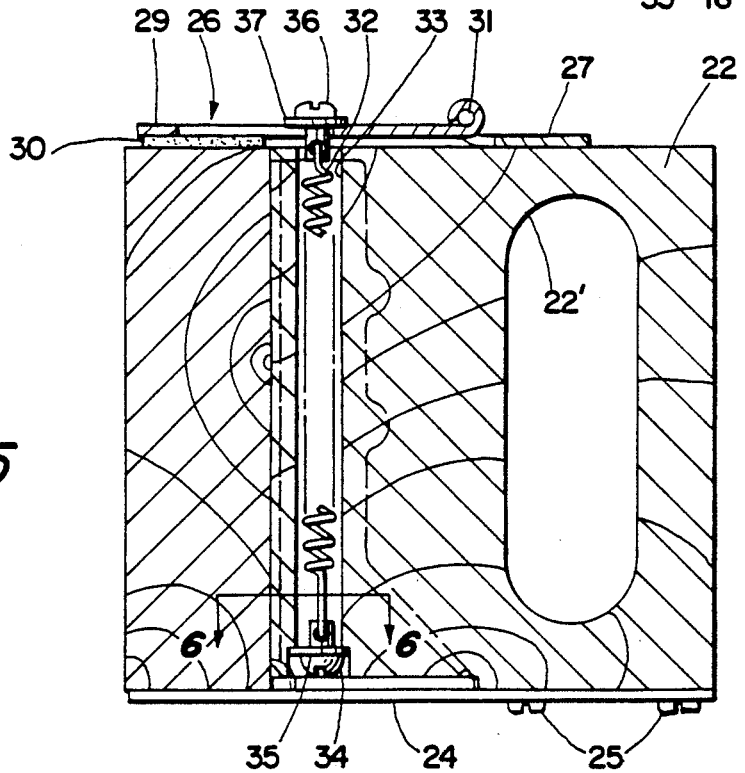
Figure 7:
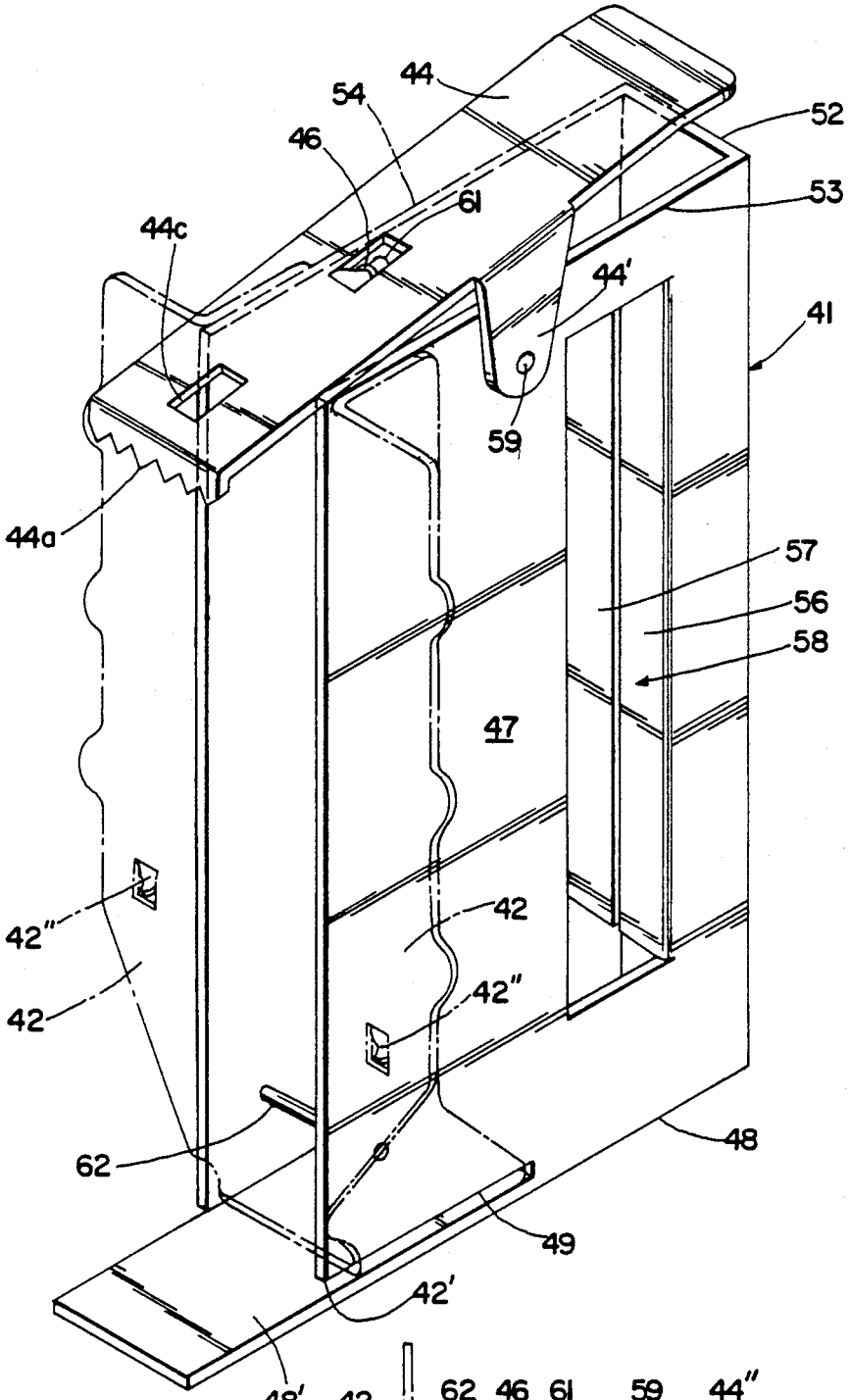
Figure 8:
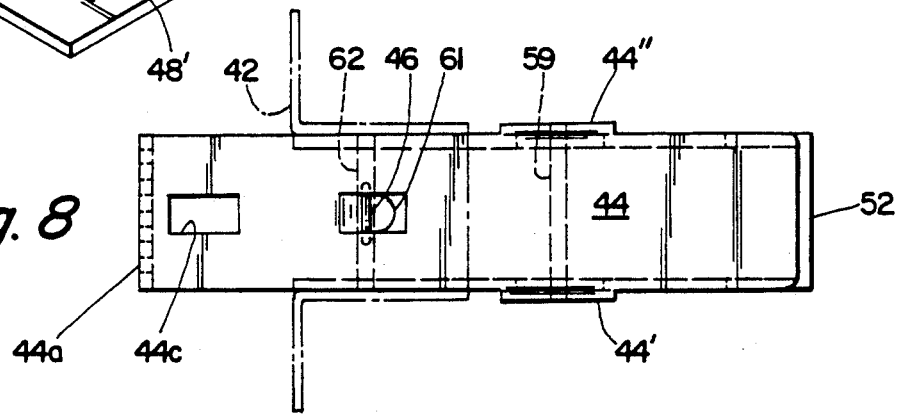
Figure 9:
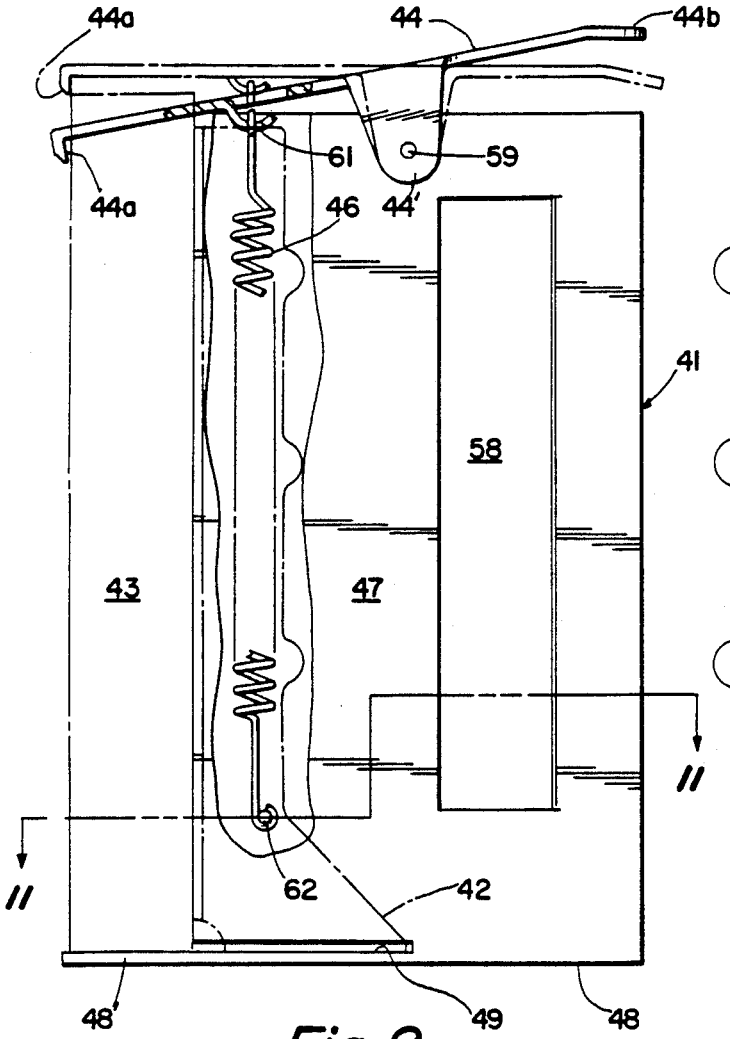
Figure 10:
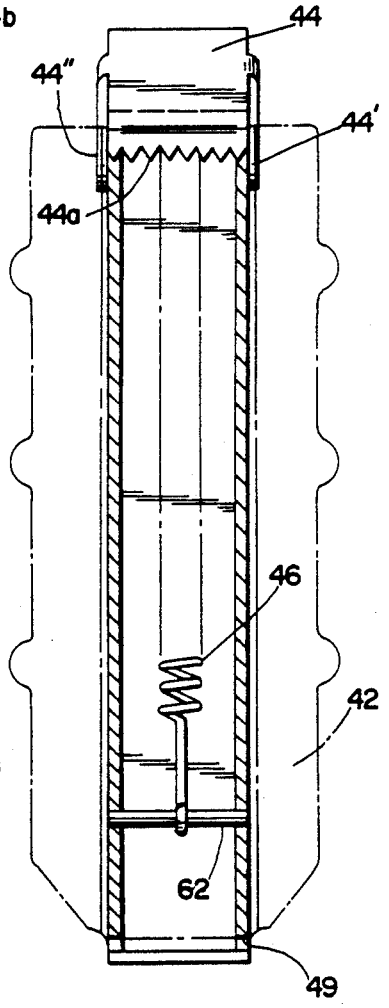
Figure 11:
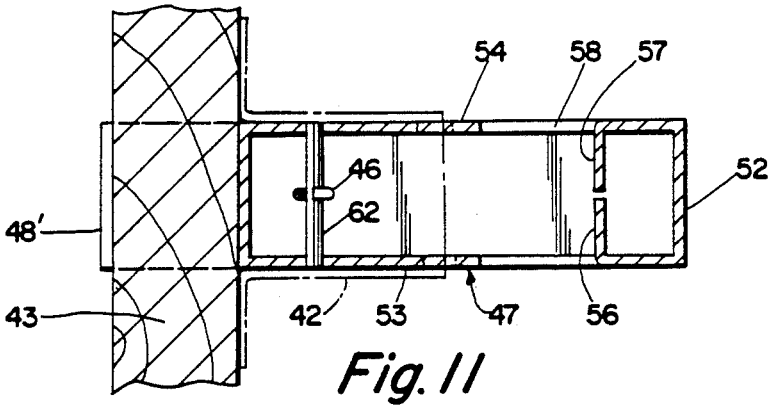

FIG. 2 is a side elevational view of the joist hanger mounting tool with the hanger placed upon the header beam, and taken looking generally from line 2—2 of FIG. 1, FIG. 3 is a top plan view of the hanger mounting tool and hanger upon the header beam, FIG. 4 is a bottom plan view of the hanger mounting tool upon the header beam, FIG. 5 is a vertical sectional view of the mounting tool with the joist hanger as viewed upon line 5—5 of FIG. 3, FIG. 6 is a fragmental sectional view taken through the top lever tension spring within its hold and taken generally on line 6—6 of FIG. 5, FIG. 7 is a front, top and side perspective view of a modified form of the invention that is adapted for use with larger size joist hangers and of light weight hollowed metal construction and with a depressible top lever, FIG. 8 is a top plan view of the modified form of the invention shown in FIG. 7, FIG. 9 is a side elevational view of the hollow metal joist hanger mounting tool with portions broken away to show the elongated top lever retaining and spring assembly thereof, FIG. 10 is a front elevational view of the modified mounting with a lower portion broken away to show the transverse anchor connection of the elongated top lever tension spring, FIG. 11 is a transverse sectional view taken generally on line 11—11 of FIG. 9

DETAIL DESCRIPTION

Referring now to FIGS. 1 to 6 inclusive for first form of the invention, 15 represents a header beam to which a series of joist hangers 16 are to be attached to a side face of the header beam at center markings, 15' locating the positions where the joist hangers are to be placed. The header beam 15 in this instance, is six inches high upon which joists of the same height are to be supported by the joist hangers 16 so their top edges will lie totally level with the top edge of the header beam and relative to each other so that a level floor may result.

Each joist hanger 16 is generally of U-shape with an interconnecting bottom portion 16' from which parallel legs angle-sections 16'' and 16''' extend upwardly for attachment to face of the header beam 15 by integral nailing prongs 17 and regular nails 18. The problem has been to hold the joist hanger 16 in proper alignment while hammering the prongs and nails. In doing this, there has been provided the present hand mounting tool 21 to which the joist hanger 16 is assembled and then placed by the tool in a marked location on the header beam 15 in a manner as illustrated in FIG. 1.

This mounting tool 21 comprises of a handle body or block 22 of exactly the same height as the header beam 15 and that has a hand opening 22 by which the tool is held. The thickness of the block 22 is that of the spacing between the upstanding angle section arms and that of the joist end to be supported in the mounted hanger 16. The under edge of the block is cut away at 23 near through half its length to slidably receive the bottom extent 16' of the joist hanger 16 on being assembled thereunto from the front of the tool 21. To hold the hanger 16 in place in the cut away 22, an elongated plate 24 is secured by screws 25 to the bottom face of the block 22 and extends forwardly over the cutaway and beyond to engage the underedge of the header beam 15 as the tool and hanger is mounted upon thereupon.

On the top face of the block 22, there is secured a hinge lever assembly 26 having a fastening plate 27 secured to the handle block 22 by screws 28 and from which a longitudinally-slotted lever 29 is hinged at 31 and spring-biased by a tension spring 32 anchored in the bottom of a long vertical hole 33 by shouldered member 34 FIG. 6. The lever 29 extends outwardly beyond the forward edge of the block 22 above the forward end of the elongated bottom plate 24 to lie over the top edge of the header beam 15. A grip pad 30 is adhered to the header engaging end of the lever 29 to reduce slippage of the tool upon the header beam once in place. Once the mounting tool with hanger is in place, the hands of the worker can be left free to nail the hanger to the beam 15.

Within the lever 26 is an elongated slot 29 through which a center marking 15' on the top of the beam may be observed, FIG. 3, and from which the upper end of tension spring 32 is anchored by a bolt 36 and washer 37. The lower end of the spring 32 is similarly anchored by member 34 and a washer 35 within the hole 33 and against a bottom shoulder 33' of the hole 33. A strong grip of the tool and the hanger is thereby made for the hammering of the prongs 17 and nails 18 to secure the hanger to the header beam.

Once the hanger 16 is fixed, the tool will be pulled from the installed hanger and be loaded with another hanger 16 for attachment at another location in the series of them to be placed spaced apart on the header beam 15. With all hangers in place on opposing header beams, the joist members can be lowered into the hangers from which they will be supported. Prongs 17' will be hammered into the joist, and nails will be driven through nail holes 18' the joists to hold them in the hanger. The top edges of the joist members lie in the same plane with one another and with the top faces of the header beams so that the flooring will be level when installed. Any twist of the joists is prohibited through the joists hanger and their proper alignment will have been assured with the use of the present hanger mounting tool.

DETAIL DESCRIPTION OF MODIFICATION

Referring now to FIGS. 7 to 11, inclusive, there is shown a modified form of the invention. A mounting tool generally indicated at 41 is sized to accommodate a joist hanger 42 suitable for a ten-inch high header beam 43. This modified mounting tool 41 differs in that it is made of the hollow metal and has a thumb depressible lever 44 at the top of the tool to grip the header beam 43 with the attached hanger tensioned by an elongated spring 46 lying within hollow mounting tool body 47. The body can be fabricated from stock pieces in numerous ways as by folding a metal sheet into a hollow metal piece as here open in the front and closed at the bottom as indicated at 48 with a forwardly extending projection 48' co-extensive therewith, a slit 49 is thus provided in bottom of tool 41 to accommodate the bottom 42 of the U-shaped joist hanger 42 and retain hanger as it is being mounted upon header beam 43. The hollow body 47 is closed at rear as indicated at 52. Sides 53 and 54 are struck inwardly respectively at 56 and 57 to provide a hand hole 58 at the rear end of the body by which the tool 41 and hanger 42 will be lifted and pressed against the face of the header beam 43 to be attached by hammering prongs 42" and then nails on removal of the mounting tool 41.

The top of the tool body 47 is also open and is covered by the spring-biased lever 44 that has opposing depending lugs 44' and 44" pivotally connected by a pivot pin 59 extending through sides 53 and 54 of the tool body. Struck down from the lever 44 is a hook formation 61 upon which the tension spring 46 is hooked to draw the lever down upon the top edge of the beam 43 as illustrated in phantom in FIG. 9 when mounting tool 41 and hanger 42 are mounted upon beam 43. The tension spring 46 depends into the tool body 47 and is anchored near the bottom by a pin 62 extending between sides 53 and 54 of the tool body 47.

The forward end of the depressible lever 44 has a bent down end **44*a* for engagement with the top edge of the beam 43 or for a narrow beam as illustrated in phantom in FIG. 9 extending over the edge thereof. The lever will be thumb depressed against the action of spring 46 from a turned down opposite end 44*b*. An opening 44*c* is provided in the overlying end of the lever 44 through which a marking on the top of the beam may be observed to aid in the placing of the tool with the hanger 42 upon the beam 43**.

It should now be apparent that there has been provided mounting tools for the installation of joist hangers upon header beams that will greatly reduce the time normally consumed in affixing joist hangers to header beams and in which accuracy will be assured.

While various changes may be made in the detail construction, it will be understood that such changes are deemed to be within the spirit and scope of the present invention as defined by the appending claims.

What is claimed is:

1. In a hand tool for mounting a joist hanger upon a header beam in which the joist hanger has upwardly-extending parallel legs of angle section interconnected by a bottom portion, a handle body having a horizontally-extending slot adapted to receive the interconnecting bottom portion of the joist hanger to permit the parallel legs of angle section to extend upwardly respectively over respective opposite sides of the mounting tool and aligned to lie flush with the front of the mounting upon placing the hanger upon a vertical face of the beam, said handle body having a plate projection underlying the bottom slot and extending forwardly of the mounting tool to underlie the underedge of the beam when affixing the hanger thereto and a vertically opposing projection extending from the top of the mounting tool to engage with the top edge of the beam, whereby the joist hanger may be retained upon the beam free of the hands in position to be nailed thereto.

2. In a hand tool for mounting a U-shaped joist hanger upon a header beam as defined in claim 1 and one of the said projections being spring-biased toward the other projection to effectively clamp the tool with a joist hanger upon the header beam and leave hands free for hammering the hanger upon the beam.

3. In a hand tool for mounting a U-shaped joist hanger upon a header beam as defined in claim 2 and the said spring-biased projection being a pivoted projection hinged to the tool body, and an elongated tension spring connected to the projection and anchored within the tool body.

4. In a hand tool for mounting a U-shaped joist hanger upon a header beam as defined in claim 2 and the said spring-biased projection being a thumb-pressed lever and an elongated tension spring connected to the lever and anchored to the tool body.

* * * * *